US007370507B2

(12) United States Patent
Cook et al.

(10) Patent No.: US 7,370,507 B2
(45) Date of Patent: May 13, 2008

(54) LUGGED CAP FORMING SYSTEM

(75) Inventors: Stephen T. Cook, Bellbrook, OH (US); Mark F. Broerman, Kettering, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 361 days.

(21) Appl. No.: 10/451,057

(22) PCT Filed: Dec. 19, 2001

(86) PCT No.: PCT/US01/49392

§ 371 (c)(1),
(2), (4) Date: Feb. 17, 2004

(87) PCT Pub. No.: WO02/49787

PCT Pub. Date: Jun. 27, 2002

(65) Prior Publication Data

US 2005/0138984 A1 Jun. 30, 2005

Related U.S. Application Data

(60) Provisional application No. 60/257,336, filed on Dec. 20, 2000.

(51) Int. Cl.
*B21J 11/00* (2006.01)

(52) U.S. Cl. ..... 72/405.13; 72/361; 72/426; 72/428

(58) Field of Classification Search ..... 72/344–346, 72/361, 405.01, 426, 38, 347, 348, 379.4, 72/405.09, 405.13, 427, 428
See application file for complete search history.

(56) References Cited

U.S. PATENT DOCUMENTS 2,343,006 A * 2/1944 Gibbs ..... 72/353.4
3,438,348 A * 4/1969 Merolle ..... 413/9
3,846,997 A 11/1974 Leis
4,723,882 A * 2/1988 Wissman et al. ..... 413/66
4,770,022 A 9/1988 Cook et al.
4,895,012 A 1/1990 Cook et al.
4,955,223 A * 9/1990 Stodd et al. ..... 72/336
5,067,341 A * 11/1991 Wynn et al. ..... 72/426
5,331,836 A * 7/1994 Cudzik ..... 72/346
5,857,375 A * 1/1999 Nelson et al. ..... 72/361
6,015,062 A 1/2000 Bachmann et al.
6,029,486 A 2/2000 Haraga et al.

(Continued)

*Primary Examiner*—Ed Tolan
(74) *Attorney, Agent, or Firm*—Fay Sharpe LLP

(57) ABSTRACT

Transfer apparatus and method are provided from first (15A, 16A) to second (15B, 16B) stations of tooling in a cap (11) making press. This cap is biased against the first upper tools by a first airstream (50) introduced under the cap and moves upward with the first station punch (45). As the punch approaches its top location, a transfer airstream (52) begins while the first airstream is still on, and moves the cap out through a transfer chute (18) to the second station. The cap departs the chute and passes detents (67) on a pair of closed retention fingers (60) which define an extension of the transfer path from the chute into the open second station tools. A vacuum (85) applied to a port in the second station punch then holds the cup against the rising upper tools. When the punch clears the closing fingers and approaches its top location, an ejection airstream (87) commences to propel the finished cup via a discharge chute (19).

5 Claims, 13 Drawing Sheets

U.S. PATENT DOCUMENTS 6,067,830 A 5/2000 Klages et al.
6,082,944 A 7/2000 Bachmann et al.
6,237,388 B1 * 5/2001 McClung et al. ..... 72/361
6,260,394 B1 7/2001 Haraga et al.

* cited by examiner

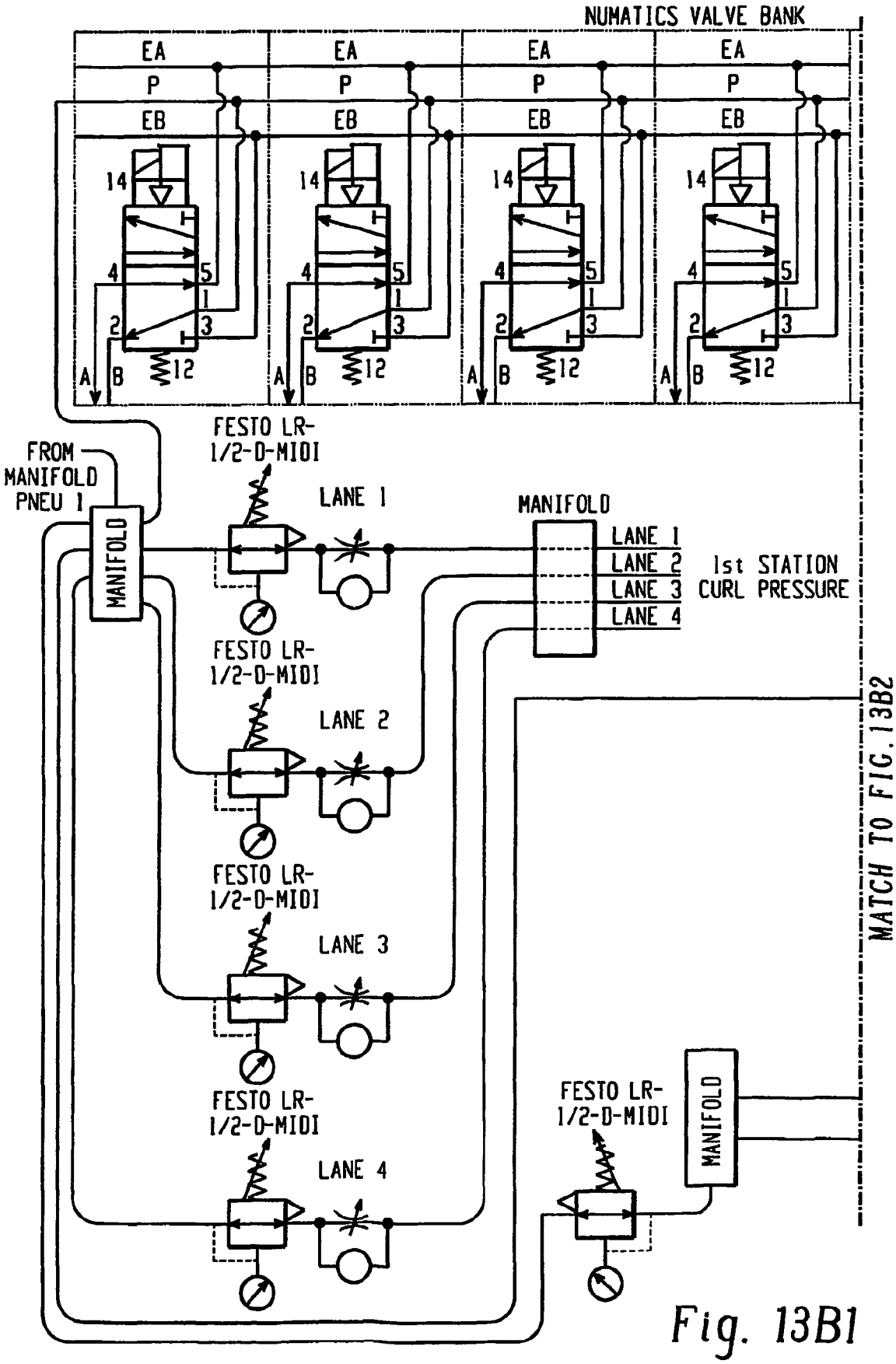
Fig. 13B1

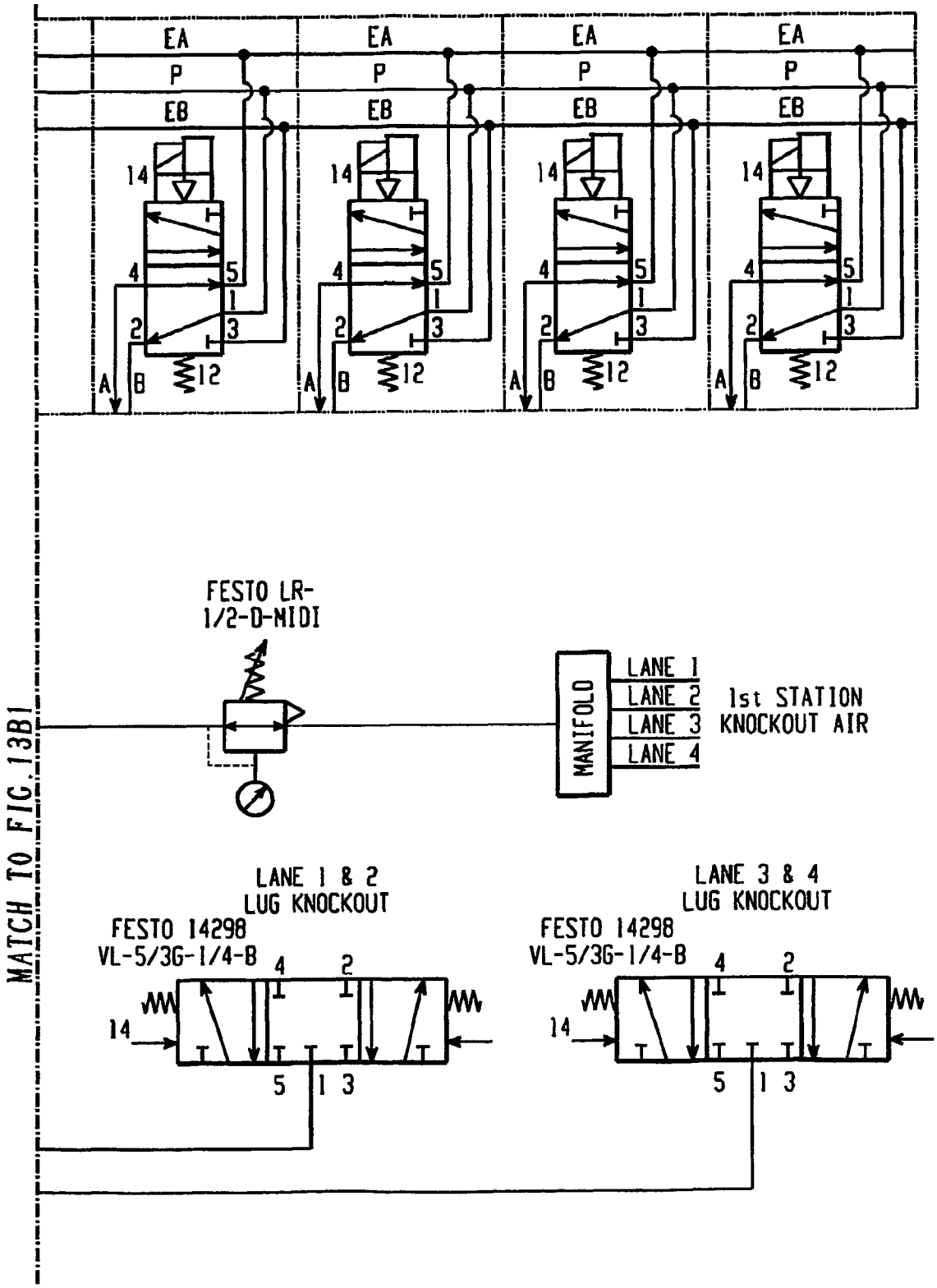
Fig. 13B2

LUGGED CAP FORMING SYSTEM

This application is a 371 filing of PCT/US2001/49392, filed Dec. 19, 2001, which claims priority from U.S. provisional application Ser. No. 60/257,336, filed Dec. 20, 2000.

BACKGROUND OF THE INVENTION

U.S. Pat. Nos. 6,082,944 and 6,015,062, assigned to the assignee of this application, disclose closure constructions for reclosable containers (e.g a can body) wherein a domed container end with a neck portion having a pour opening is provided with a reclosable lugged type of cap. That invention provides a unique and versatile container for fluids, particularly for beverages, wherein various standard can bodies are provided with a two part end including a neck with a pour opening, a lug formation on the neck below the pour opening, a reclosable cap having a lug formation which can interlock with the lug formation on the neck and including a seal surrounding the pour opening, and thus capable of maintaining product under pressure. The two part end is affixed to a can body by conventional double rolled seam attachment between the bottom of the neck and the rim of the can body. However, it is possible to affix the domed end to a can body without a cap, fill the can though the pour opening, and then apply the cap.

With the possibility of expanded markets for these lugged caps, which are also useful on various jars and bottles, there is a need for a system (method and tooling) for producing lugged cap members in a single machine, e.g. a reciprocating press fitted with appropriate tooling, which is capable of precise high speed (e.g. in the range of 135 to 150 strokes/minute) to achieve acceptable commercial production of the cap.

To develop such production speeds it is desirable to divide the progressive tooling operations into more than one step, and this in turn requires a rapid and precise transfer system to move the partially completed caps from a first station to a second station, and precisely register the caps in the second station. Prior art transfer systems are known for moving and registering can end shells, such as in U.S. Pat. Nos. 4,770,022 and 4,895,012, however, the end shells are relatively flat disc-like objects with a quite small height to diameter ratio, whereas the caps made by the present invention have a substantially greater height with respect to their diameter.

Thus, the physical dimensions of the caps involved in this invention are quite different from can shells or easy self-opening can ends. This in turn introduces needs not required or anticipated in shell transfer systems, for example with regard to tipping of the caps during high speed transfer operations. Also, because of the relatively high press cycling, and need for precision in cap positioning and deceleration immediately after each transfer to another press station, there is a requirement for precise transfer of each cap from a first press station through high acceleration, very rapid transfer to the next press station, and high deceleration to a precisely defined stationary location at that next station.

SUMMARY OF THE INVENTION

The present invention provides a transfer apparatus and method for a first to a second station of progressive tooling in a cap making press. The caps are of a type having substantial height with respect to their diameter. Thus a first station punch and die form a cap of generally inverted cup shape, with an outward curled rim, and a second station punch and die form lugs into that rim, requiring just two strokes of the press to sever a disc from a supply sheet, form it, and discharge a completed cap.

Thus, in the first station, a cap is formed except for lugs which are added to the cap in the second station. The formed cap in the first station, which is in the nature of an inverted cup, has an outward curl formed on its lower edge during the initial up stoke of the press. This cup is then biased against the upper forming punch, by a first airstream introduced into the cavity within the underside of the cap, and moves upward in contact with the first station punch. As the punch approaches its top dead center location (tooling fully open), a second airstream begins, before the first station punch is fully raised and while the first airstream is still on. This second airstream moves the cap off the raised first station punch, and into and through a transfer chute directed toward the second station.

At the second station, the cap departs the chute and passes detents on a pair of closed retention fingers which, with the tooling open, define an extension of the transfer path from the chute into the open second station tools. As the second station tools begin to close and the partially finished cap is located, the fingers are opened and the tooling operates to form lugs into the cap rim.

As the second station tooling opens, a vacuum applied to a port in the second station punch begins to hold the finished cup against that punch tool, and when that punch clears the closing fingers and approaches its top dead center location, an ejection airstream commences to propel the finished cup from the tooling via a discharge chute.

BRIEF DESCRIPTION OF THE DRAWINGS

FIGS. 13A and 13B1 & 13B2 (three sheets) together are a schematic diagram of the pneumatic supply & control system of the press and tooling.

DESCRIPTION OF PREFERRED EMBODIMENT

Figure 1:
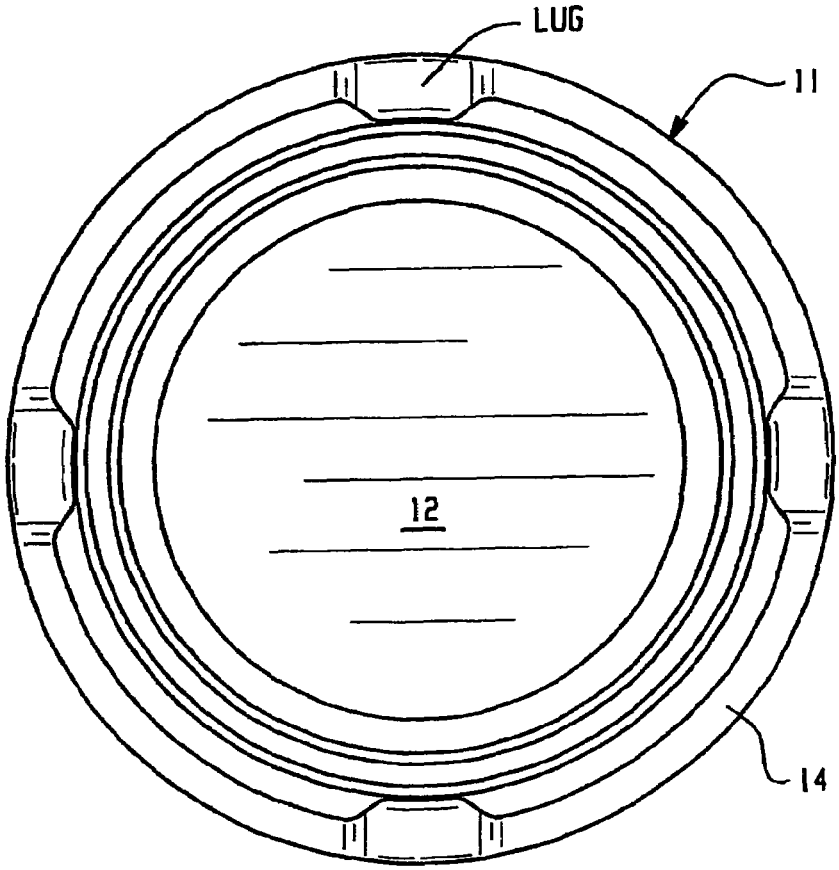
FIG. 1 is a bottom view of a container cap as provided by the invention.
Figure 2:
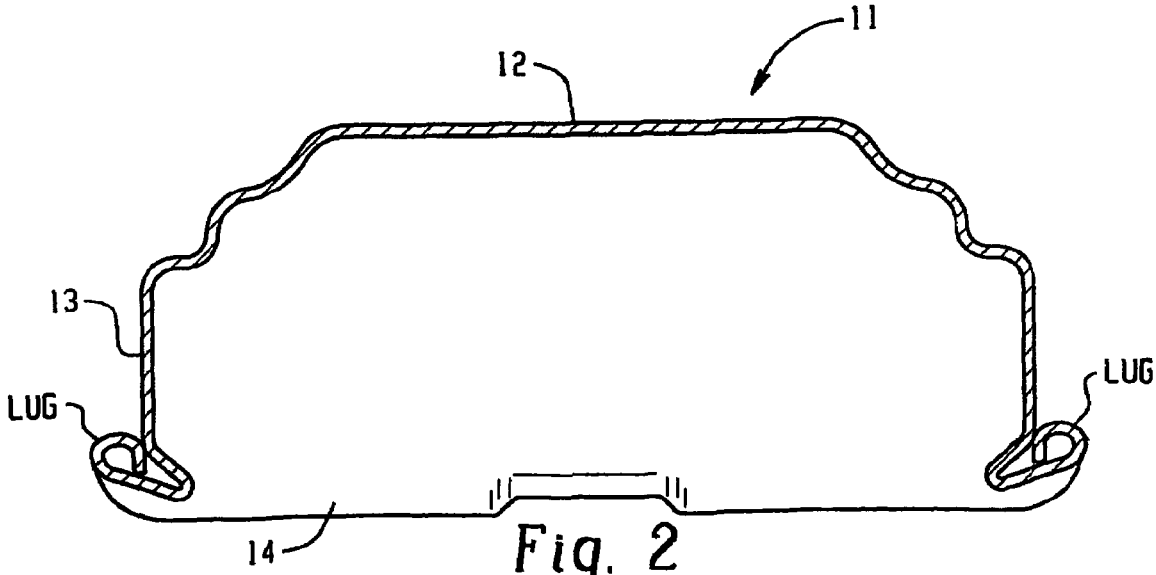
FIG. 2 is a transverse cross-sectional view of a typical completed cap, as shown in FIG. 1.

The present invention provides a transfer apparatus and method for two station progressive tooling in a cap making press and system. The caps are of a type having substantial height with respect to their diameter. A typical such cap is shown in FIGS. 1 and 2, which is also shown in FIGS. 2, 4A and 4B of U.S. Pat. No. 6,015,062. The preferably integral cap 11, in the general form of an inverted cup, includes a top panel 12, a peripheral sidewall 13, and a curled rim 14.

In the present drawings, FIGS. 3-12A depict multi-lane progressive tooling comprising four lanes for simultaneously forming four caps 11, each lane comprising pairs of first and second tooling stations 15A, 15B, 16A, 16B, 17A,17B, and 18A, 18B, with the first stations 15A-18A arranged centrally of the tooling (FIGS. 3, 4 & 5) and corresponding second stations 16A-16B arranged outward of the first stations toward opposite sides of the upper and lower die plates 20A, 20B which support the upper (punch) and lower (die) tooling, and mount between the bed and slide of a reciprocating press (not shown).

Except for their orientation in the overall tooling package, the respective first station and second station tools are alike, and the following detailed description applies to all. Taking stations 15A and 15B as examples, each pair of corresponding first and second stations has an associated transfer chute 19 (FIGS. 4, 5 & 9) between them, and each second station has a discharge chute 19A, the four of which are directed out opposite sides of the tooling (FIGS. 3 & 4).

Figure 3:
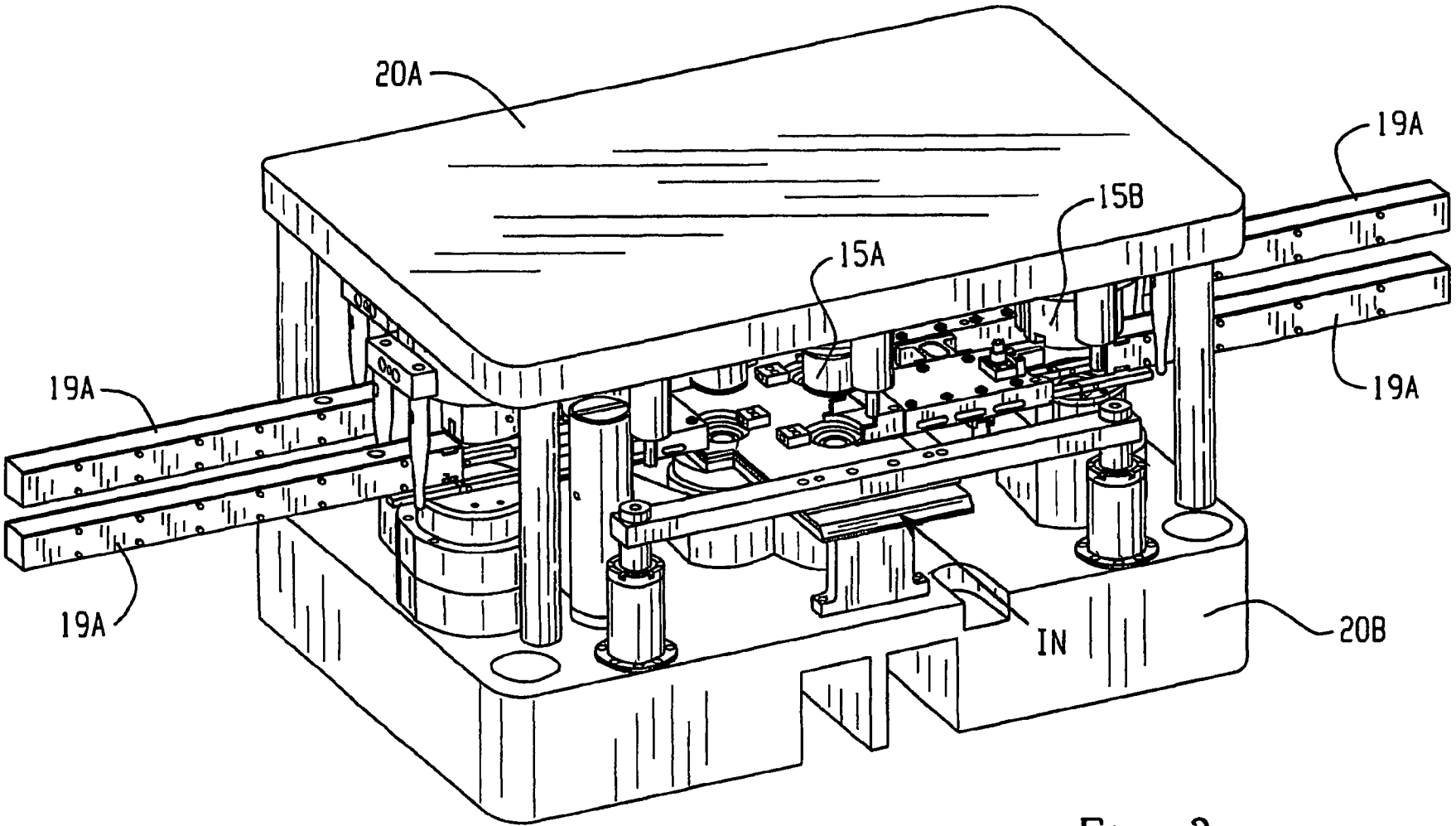
FIG. 3 is an over all perspective view of the tooling for a four-out cap making system.
Figure 4:
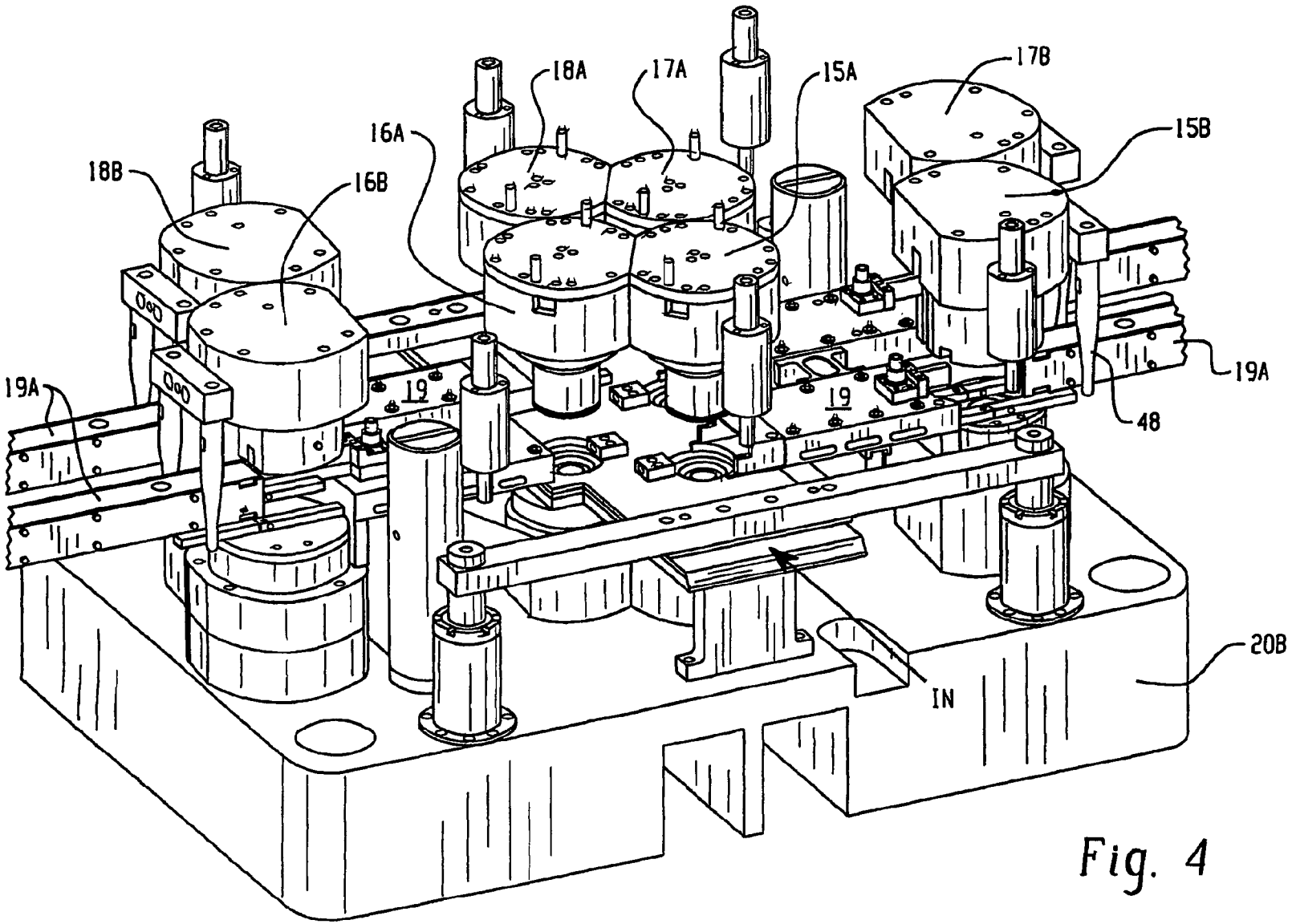
FIG. 4 is an enlarged perspective view, with the die shoe removed, showing details of the tooling, including four first station tools in the center and four related second station tools outwardly in opposite directions of the first stations.
Figure 5:
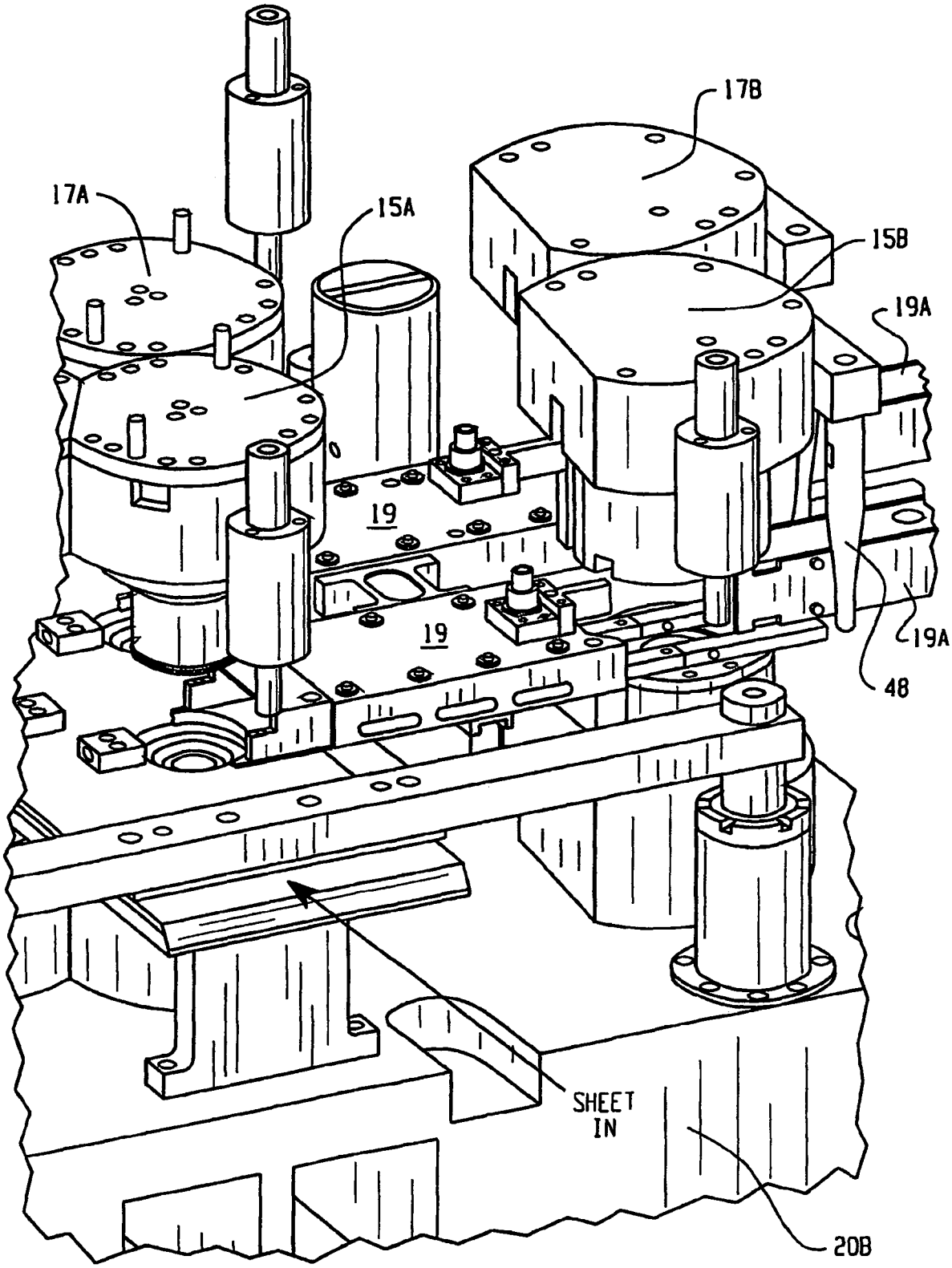
FIG. 5 is a further enlarged perspective view showing details of one pair of first and second stations of the tooling.

Sheets of metal, with an appropriate pattern of lithographed materials for each cap, are fed centrally into the first stations by sheet feeding mechanism of known construction (not shown) which moves the sheets one at a time in step wise fashion, synchronized to the press strokes, along the feed path indicated by arrow IN in FIGS. 3 & 4.

First Station

Figure 6:
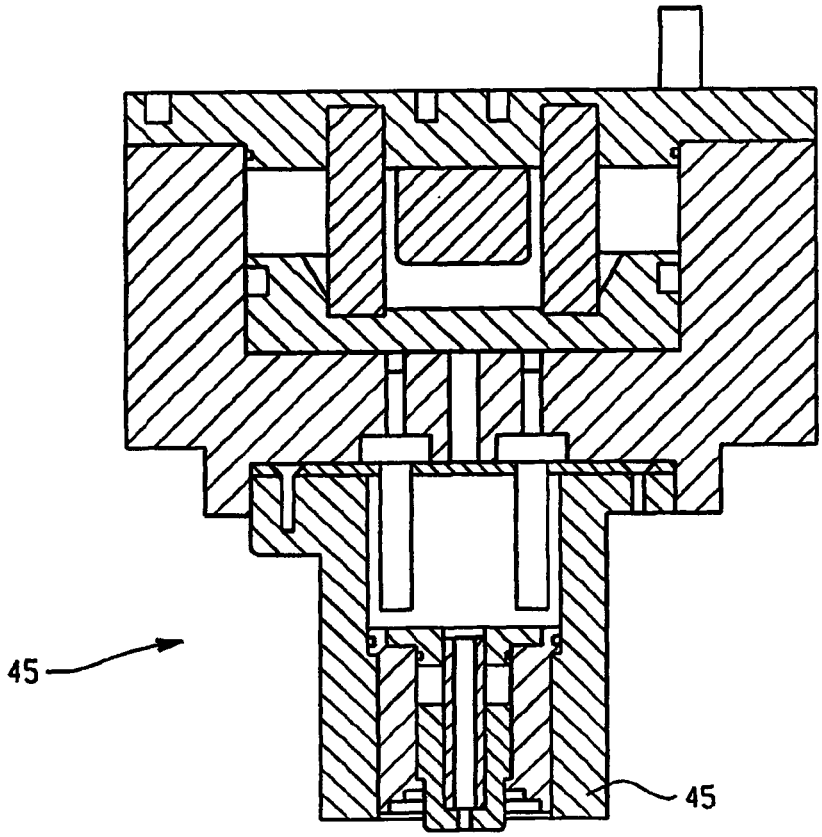
FIG. 6 is a cross-section view of a first station punch or upper tool.
Figure 7:
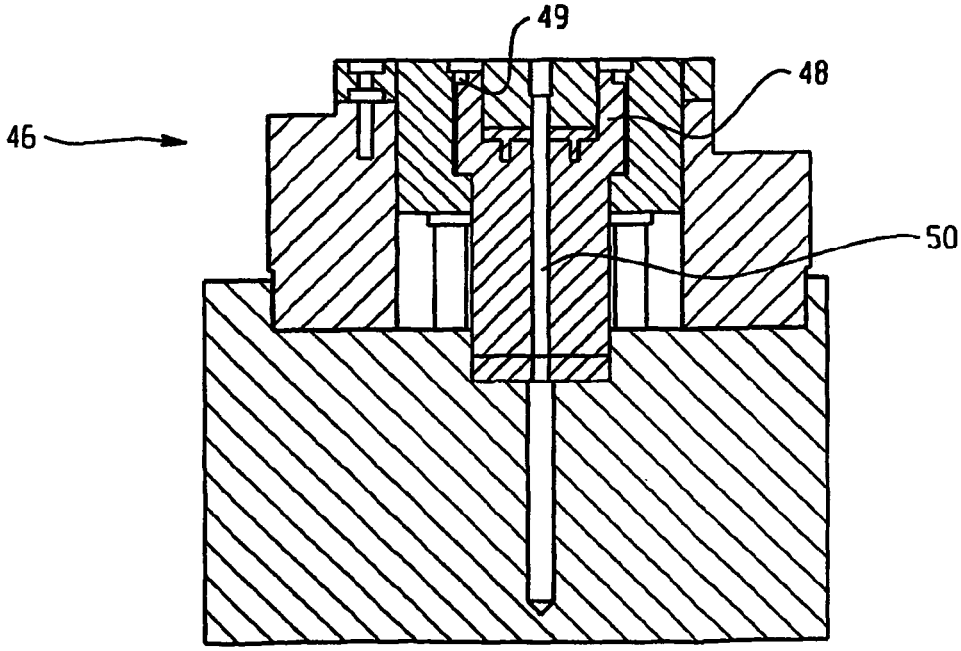
FIG. 7 is a cross-section view of a first station die or lower tool.
Figure 8:
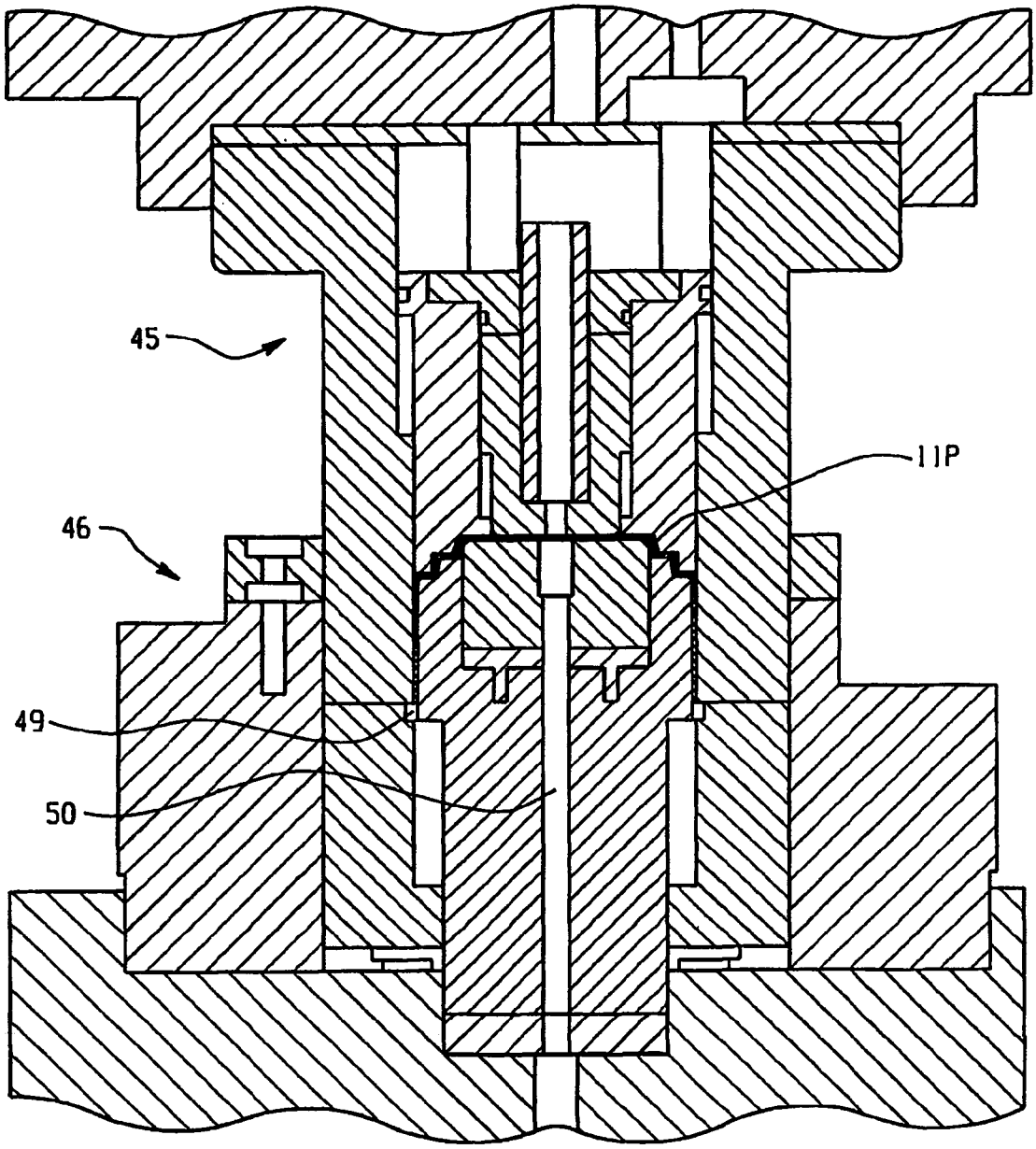
FIG. 8 is a cross-section view illustrating the first station punch and die in closed position, and showing a cap formed except for an outward curl at the lower rim of the cap.
Figure 9:
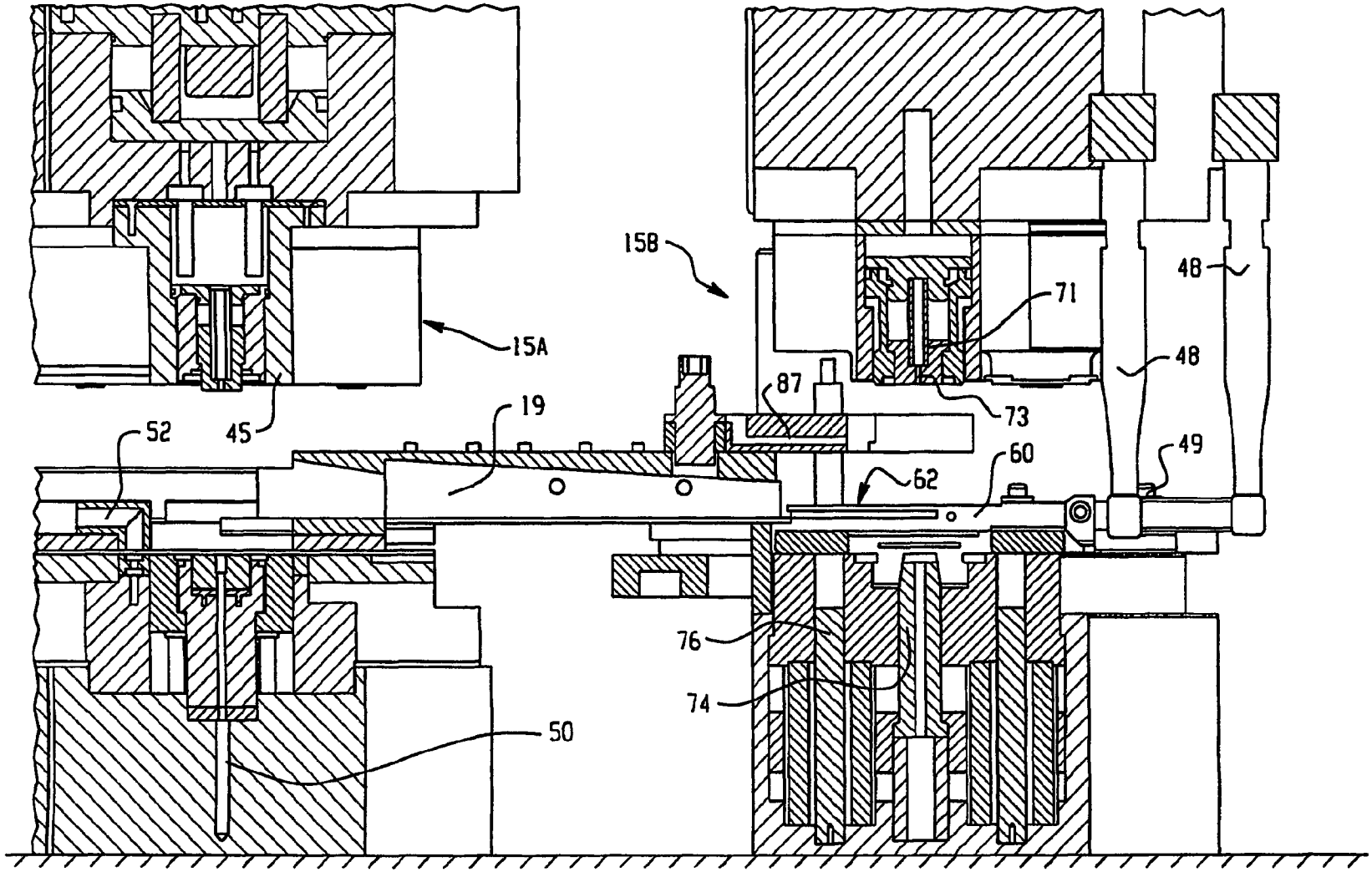
FIG. 9 is a cross-section view showing first station and corresponding second station tools, a transfer chute between them, the fingers which provide an extension of the chute into the second stage tool, and cams which control movement of the fingers.

The first station tools comprise an upper or blank punch tool 45 and a compound lower die. During the initial operation of the first station tools, with the lithographed patterns aligned with respect to the first station tools, a blank is cut from the material (typically aluminum or thin cold rolled steel) on the down stroke of the press by blank punch 45. On the continuation of the down stroke, the blank punch and lower die tool cooperate such that the blank is drawn into a cup shaped cap part 11P (FIG. 8). At the bottom of the stroke the panel shape 12 is formed into the top of cap part lip by the punch 45 and cooperating die 46 (FIGS. 6, 7 & 8).

On the up stroke, the lower curl ring 48, which is under spring pressure, raises with the blank punch. The bottom edge of the cap part 11P is curled outward into the cavity 49 formed by curl ring 48 and blank punch 45, completing a formed cap 11 with an outward curled rim 15.

The formed cap in the first station, which is in the nature of an inverted cup, is biased against the upper forming die by a first airstream introduced through passage 50 (see FIGS. 8 & 9) into the cap as the first station tooling opens, and causes the cap to follow upward against the bottom of the punch 45. During the upward travel of the cap, a second airstream is initiated through a nozzle 52 directed across the upper first station tooling toward chute 19, and is at its full power when punch 45 (with a cap 11 held thereto by the upward directed first airstream) traverses the space between nozzle 52 and the entry to chute 19 (see FIG. 9). By the time the first station tooling reaches full open at the top-dead-center of a press stroke, the cap has actually been transferred into the second station 15B; see Press Rotation timing chart below (page 8).

Thus, the first and second airstreams, appropriately switched on and off, together with the associated chute, constitute a first part of an essentially passive press transfer system.

Second Station

At the second station, a separated pair of fingers 60 reach around the sides of the second station tooling (FIGS. 9, 10 & 11), defining partial sides of a receiving space 62 when the second station tooling is open, and an extension of the transfer chute when closed. The fingers are supported by pivots 63 inward of their rear ends 61, and are biased into their closed position (FIG. 10, forward ends parallel) by spring mechanism 64. Each finger has a narrow ledge-like track 65 extending part way along its forward upper edge (FIGS. 10-12), facing each other and ending in a curved section 66. Extending horizontally inward over tracks 65 are spring-loaded ball detents 67 which, together with the curved track sections 66, define the termination of the transfer path for the incoming caps.

Figure 11:
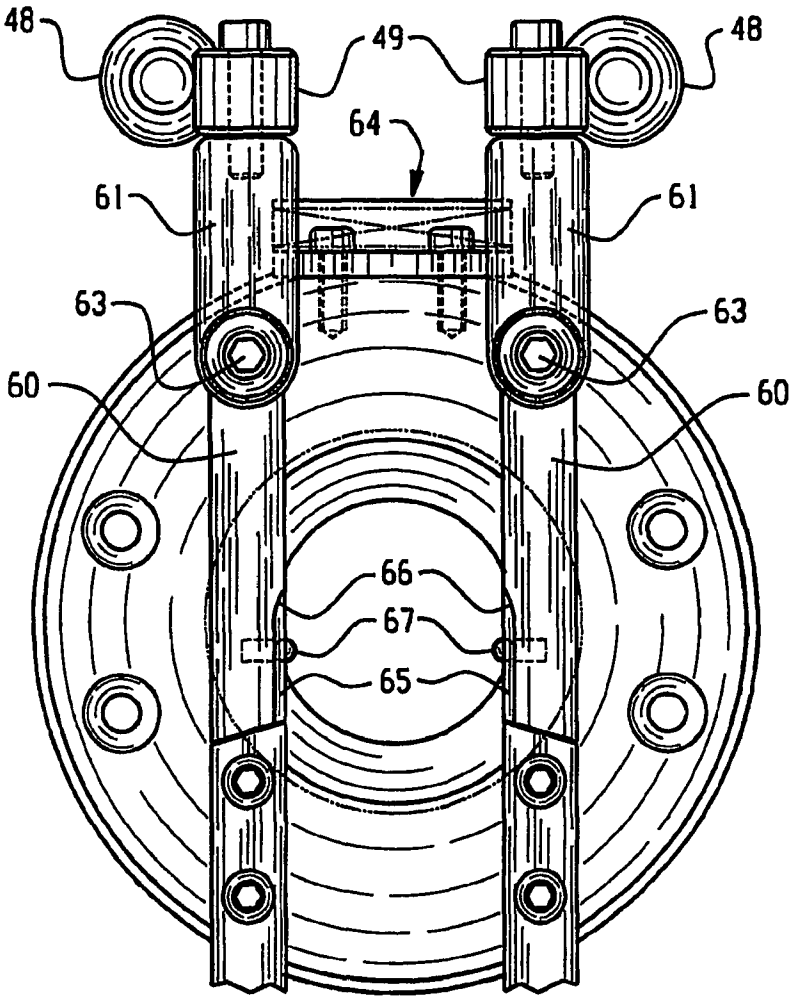
FIGS. 10 and 11 are detail views of the top of the second station die, showing the open and closed positions of the fingers.
Figure 10:
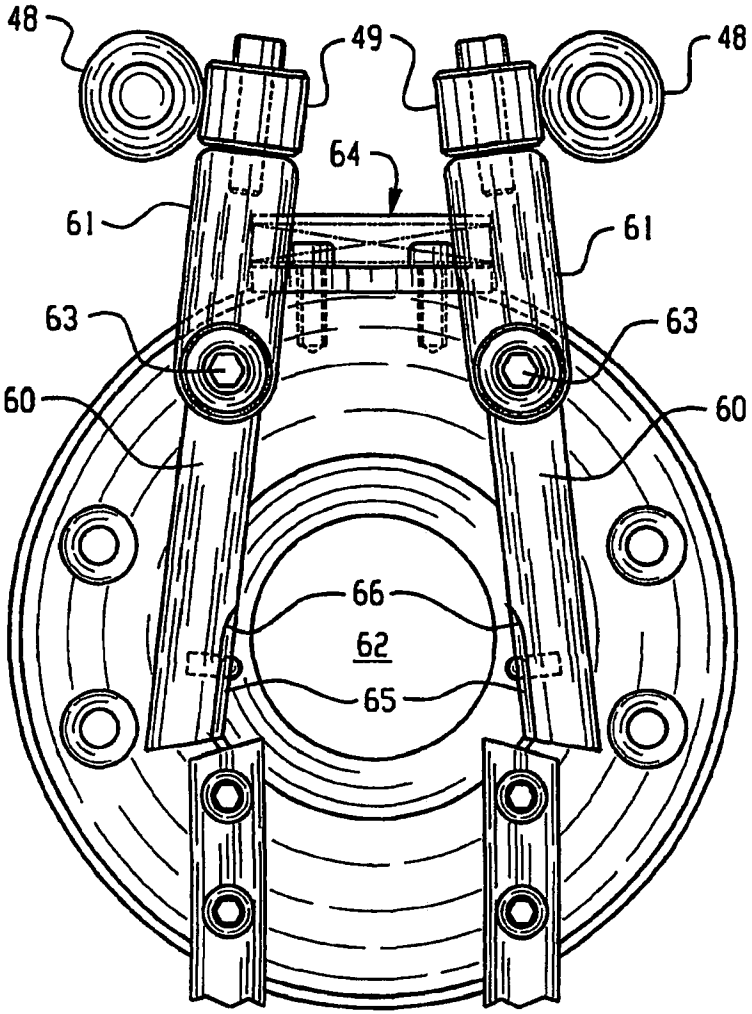
Figure 12A:
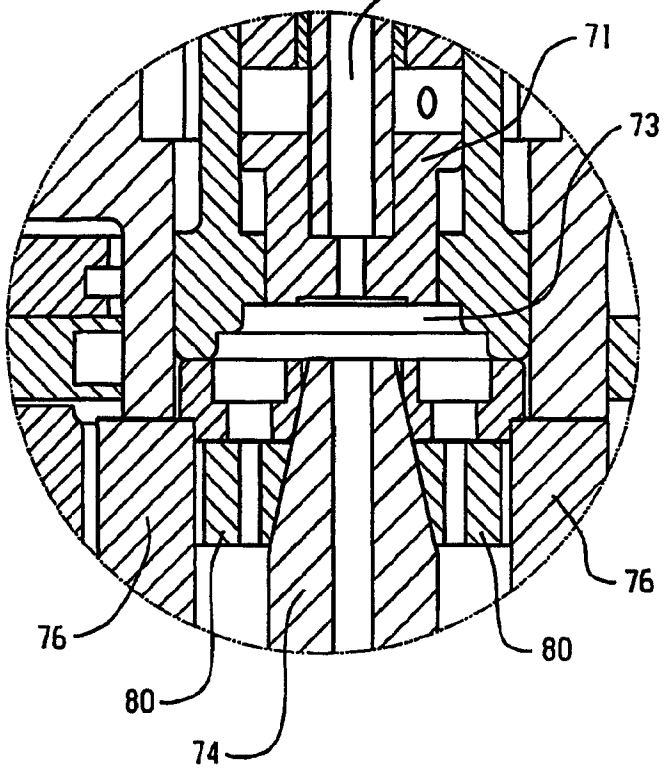
FIG. 12A is a further enlargement of the circled area in the center of FIG. 12.
Figure 12:
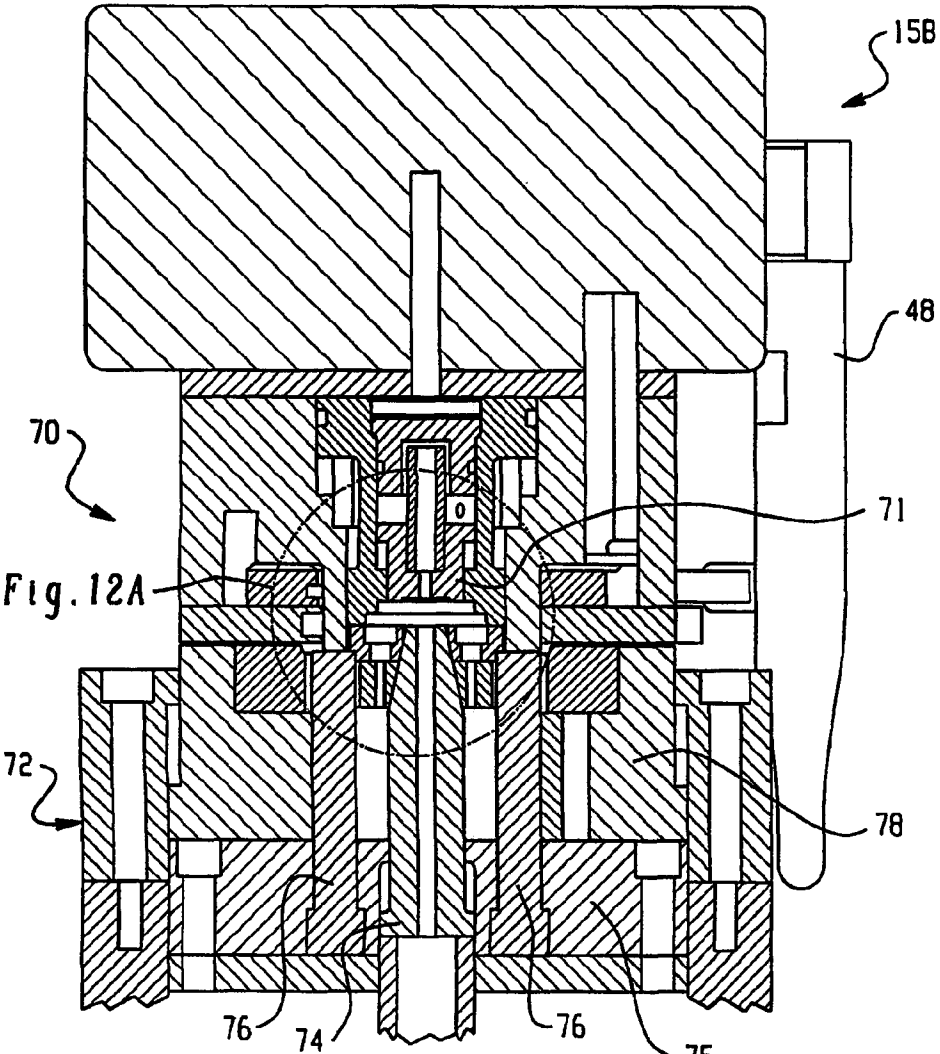
FIG. 12 is an enlarged cross-section view of the second station tools.

A cap propelled from the first station traverses the adjacent transfer chute 19 and enters receiving space 62, passing across ball detents 67 and resting against the curved track sections 66 (see FIG. 11). The fingers and their operating mechanism form the remainder of the unique transfer system.

As the tooling proceeds to close during the beginning of a next stroke, fingers 60 are swung outward by descending cams 48 pressing against followers 49 on the rear ends 61 of the fingers to move the followers 49 inward and the forward section of the fingers outward (FIGS. 10 & 12) before the second station tools close. The elongated cams 48 are mounted on the upper (die) tooling base (FIG. 12), and this action centers a cap (FIG. 11) and then opens the fingers associated with the second station tooling, before that tooling closes to form lugs on rim 15 of a cap 11. This closing action of fingers 60 is momentary, and they are then opened substantially before the second station tooling closes; see Press Rotation timing chart below.

In the second station 15B in the press, the tooling includes an upper punch 70 and a lower die 72. The punch tool 70 includes an annular knock out ring 71 with an inner shape conforming to a cap exterior, and a headed knock out pin 73 which is spring loaded toward a position flush with the lower edge of ring 71 (FIGS. 12 & 12A) when the tooling is opened. In the lower die 72 there is a vertically extending tapered cam 74 mounted onto a base plate 75 and surrounded by a plurality of die pins 76 also mounted onto plate 75. The cam 74 and pins 76 project through a vertically movable, upwardly biased ring 78 which contains a plurality of lug forming dies 80, equal in number to pins 76 and movable laterally outward through forces from cam 74 as it is made to enter ring 78. The top of ring 78 has an upper surface 82 contoured to fit within a cap 11.

Thus, when the second station tooling closes a cap is positioned with the curled rim 15 between the upper ends of pins 76 and the radially outward moving forming dies 80, to for the predetermined number of lugs in the rim (FIG. 1). Then, the completed cap is held to the knockout pin by means of a vacuum created in passage 85 though the head of that pin 73, such that the cap is carried upward past an air nozzle 87 directed across the path of the rising upper tool toward an associated discharge chute 19A. The vacuum is created by air flow through a small venturi (not shown) so the vacuum is relieved immediately upon cessation of air flow through that venturi. A discharge air stream is started from nozzle 87 and moves the cap from the upper knock out ring and pin, into and through the associated discharge chute 19.

Press Rotation Relation to Tooling Function

1st Station

0° Top of the Stroke; Top Dead Center

140° Material is Blanked

180° Form & draw complete; Bottom Dead Center; Cap Overall Height ~0.810 inch

190° Cap Curl complete; Overall Height is ~0.625 inch

190° 1st Air turned on; Blows cap against punch tool

220° Blank punch exits Die tool, cap against its face

230° 2nd Transfer Air on; Blows cap into transfer chute

330° 1st Cap arrives into catch fingers at 2nd Station.

2nd Station

0° Top of a stroke; Top Dead Center

60° Upper vacuum is turned on

136° Catch fingers start open, upper vacuum holds 1st cap against upper knockout and tools close 180° Lugs formed in 1st cap; Bottom Dead Center 181° 1st cap (completed) and tools move up together 224° Catch fingers close completely after tooling passes 270° Upper vacuum to knockout turned off 280° Discharge air valve to nozzle is turned on 290° Knock out air to nozzle 87 is turned on 330° 2nd Cap arrives into catch fingers 336° 1st Cap actually moves to discharge position 335° Vacuum actually turns off on Cap #1

350° 1st Cap actually leaves press via chute 19

Figure 13A:
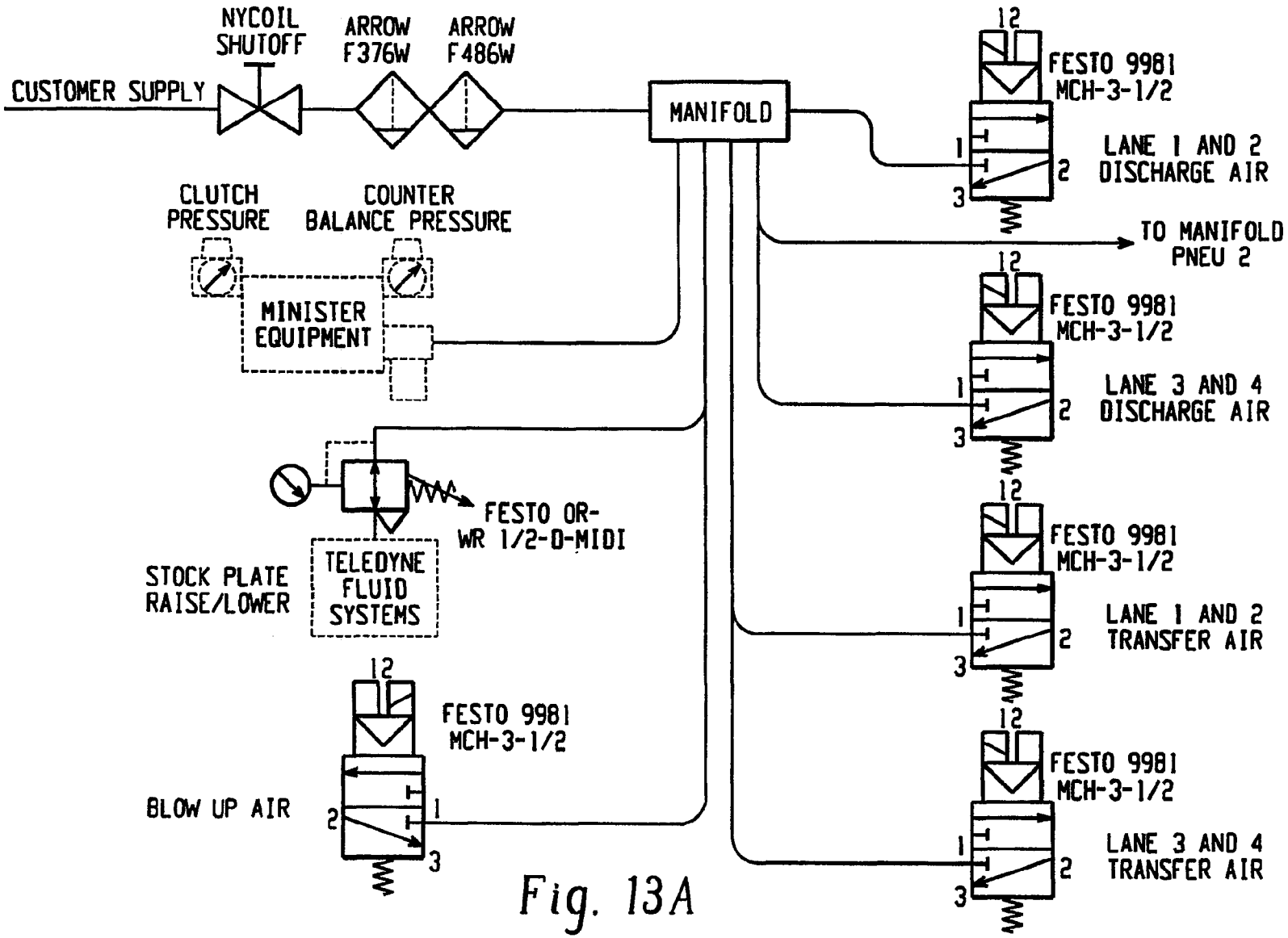
Figure 14:
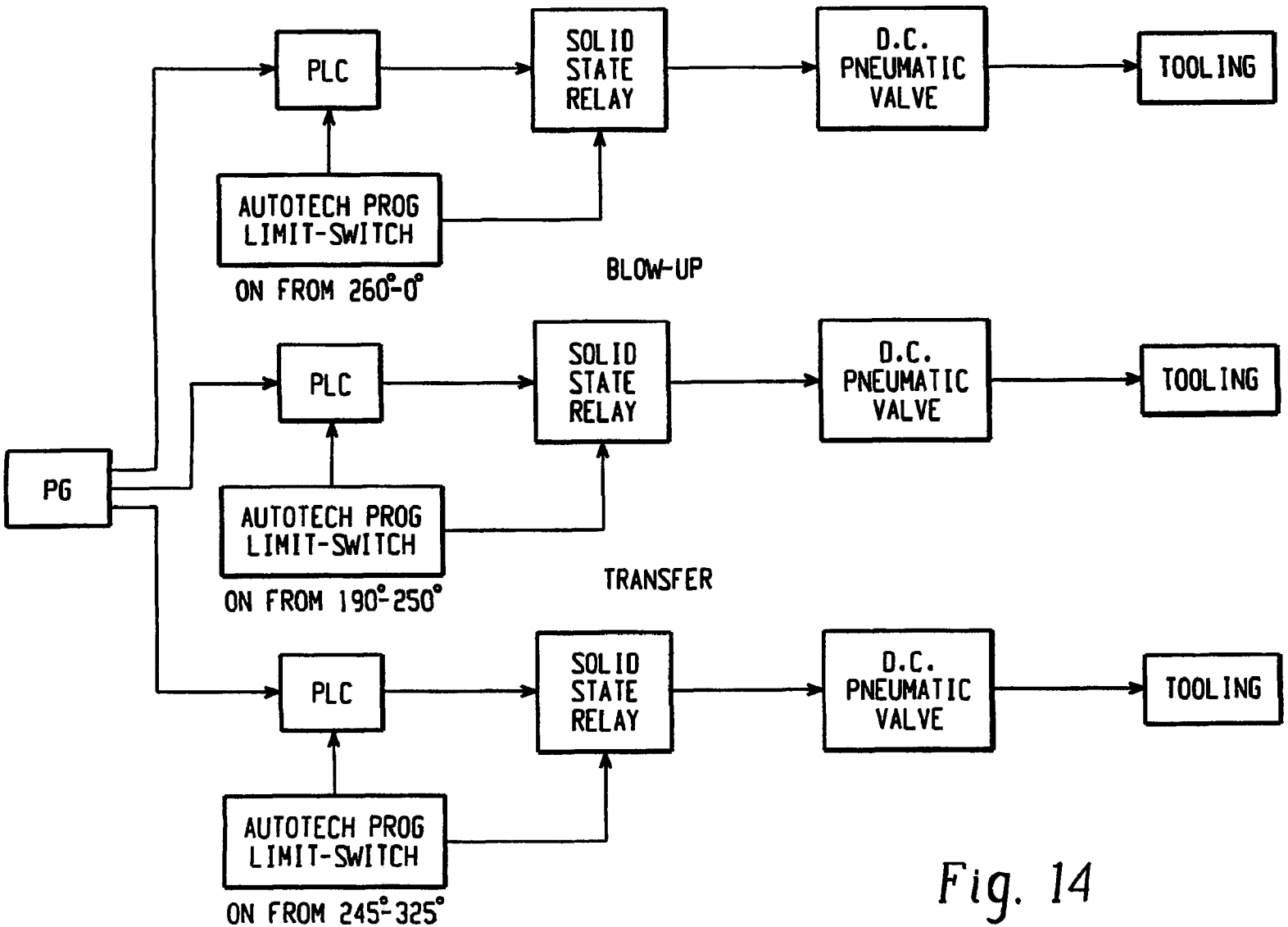
FIG. 14 is a flow diagram of the electronic control system for the tooling package.

FIGS. 13A and 13B comprise a pneumatic diagram for the pneumatic portion of the press control. A "shop air" source of compressed air is supplied to the various electrically controlled valves (which are all labeled) to direct air under pressure to the above mentioned parts of the tooling, under management control of the electronics control (FIG. 14) of the system. The details of such controls are apparent to persons skilled in this art from these diagrams FIG. 14 is a block diagram of electrical/electronics controls for the system, which selectively turn on and off the compressed air to the nozzles providing lift or "blow up" air to hold the cap part against the rising upper tools in the first station, and providing a transfer air stream to quickly move a cap part into a transfer chute 19. The third (upper) control provides timed discharge airstreams through nozzles 87 to move the finished caps into the discharge chutes 19A. A pulse generator PG is driven by the press crankshaft (not shown) in typical fashion to generate a train of pulses related to the angular position of the crankshaft as it rotates, and these pulses are directed to the system PLC (Programmable Logic Controller). Since the diagram is divided into three functions which occur during a press cycle, the controller PLC is shown in each of the three diagram parts, but in fact one PLC is employed in the control system.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. In a cap making system for forming integral reclosable container caps from sheet metal in a reciprocating press, said caps having a substantial height with respect to their diameter for fitting around and over a container neck portion with a pour opening, said system comprising a first station and a second station mounted in the press at a predetermined distance apart, said first station including first station tools comprising a blank punch tool and a cooperating compound die tool mounted in a reciprocating press for cyclic movement between an open position in which said tools are separated and a closed position in which said tools are closely spaced to form a cap from a metal blank, said first station tools operating to separate a blank from a supply of thin sheet metal during initial closing motion of said first station tools and then to draw the blank into a cup shaped part having a top panel and a cylindrical side wall extending from said top panel, and then to form an outward curled rim on the open lower edge of the cup shaped part, said second station being aligned with and spaced from said first station, said second station including second station tools mounted in the press laterally of said first station tools for receiving parts from said first station tools and performing further operations thereon, a chute extending between said first station and second station tools at their open position and receiving parts in transfer from said first station tools toward the second station tools, said chute terminating adjacent the interface of said second station tools at their closed position, a set of spaced apart guide fingers shaped to form a continuation of said chute, said fingers being supported on opposite sides of the second station tools for movement toward and away from said second station tools, means for moving said fingers apart during closing of the second station tools and for moving said fingers into an extension of said chute when the second station tools are open, means projecting a first air stream into the interior of a cup shaped part in said first station tools to hold the top panel of said cup shaped part against said blank punch tool during separating motion of said first station tools upon forming a part, means projecting a second air stream across said blank punch tool at its open position and into said chute to propel cap parts into said second station tools, and control means coordinated with the operation of the press and connected to said means for projecting first and second airstreams for switching on said first and second air stream projecting means to (a) initiate the first air stream at the beginning of separation of said first station tools and maintaining the first air stream at least until said first station tools are fully separated, and (b) initiate the second air stream before said first station tools are fully separated and maintaining the second air stream sufficiently to propel the part through said chute.

2. A system as defined in claim 1, wherein said fingers have complementary tracks formed thereon to receive and guide a part exiting said cute, said tracks having inwardly curved end sections positioned to align with the center of the second station tools to form a termination of the path of a cap part entering the second station tools, and cam means operated by the press in coordination with opening and closing of the second section tools to move the fingers apart when the tools are closing and to close the fingers into a chute extension when the tools are opening.

3. A system as defined in claim 2, wherein said finger tracks include detents spaced from said inwardly curved end sections to define a centered position of the part along said curved end sections.

4. A system for forming reclosable container caps having a cylindrical body of substantial height with respect to its diameter and an integral upper end panel for fitting around and enclosing a container neck portion with a pour opening against which said end panel can seal; comprising a first station including first station tools comprising a blank punch tool and a cooperating compound die tool adapted for mounting in a reciprocating press for cyclic movement between an open position in which said blank punch and compound die tools are separated and a closed interface position in which said blank punch and compound die tools are closely spaced, said blank punch tool and compound die tool being mounted in a reciprocating press and cooperating during cyclic operation of the press to form a cap from a metal blank separated from a supply of thin sheet metal during closing motion of said tools and then enclosed between said tools, said blank tool and compound die tool further cooperating during further closing action to draw the blank into a cup shaped part with a top panel and a cylindrical side wall extending from said top panel, and said blank tool and compound die tool then forming an outward rolled rim on the side wall, a second station laterally aligned with and spaced from said first station, said second station including second station tools for receiving parts from said first station and performing a lug shaping operation on the rolled rim, the lugs extending inward into the rolled rim, a chute extending between said first and second stations at the open position of said first station tool to guide parts in transfer from the first station into the second station, said chute terminating adjacent the interface of the second station tools, a set of spaced apart guide fingers forming a continuation of said chute, said fingers being pivotally supported on opposite sides of the second station tools for opening and closing motion perpendicular to said second station tools to clear the closing path of the second station tools to provide for closing of the second station tools with said fingers moved apart and for closing motion of said fingers into an extension of said chute when the second station tools are open, said fingers having complementary tracks formed thereon to receive and guide a part exiting said chute, said tracks having inwardly curved end sections which align with the center of the second station tools, said finger tracks include detents spaced from said curved end sections to define a centered position of incoming parts and to provide a termination of a path of a cap part entering the second station tools, cam means operated by the press in coordination with opening and closing of the second section tools to move the fingers apart when the tools are closing and to close the fingers into a chute extension when the tools are opening, means projecting a first air stream into the part to hold the upper end panel against said blank punch tool during separating motion of said first station tools upon forming of a part, means projecting a second air stream across said blank punch tool at its open position and into said chute so as to propel cap parts into said second station, and control means coordinated with the operation of the press for switching on said first and second air stream projecting means to (a) initiate the first air stream at the beginning of separation of said first station tools and maintaining the first air stream at least until said first station tools are fully separated, and (b) initiate the second air stream before said first station tools are fully separated and maintaining the second air stream sufficiently to propel the part through said chute, said control means including an input pulse generator driven in synchronism with cyclic operation of the press to generate a train of control pulses related to an angular position of a press crankshaft as the press crankshaft rotates to open and close the tools, whereby initiation and termination of said air stream projecting means is synchronized with cyclic operation of the tools.

5. A method for discharging and transferring a cup shaped object having a substantial height with respect to its diameter from a work station, said work station having upper and lower tooling which is opened and closed to form the object, along a transfer path, the open position of the upper tooling defining a ready position, comprising the steps of:

(a) locating and holding the object within the work station by directing a first stream of pressurized gas against the object to cause the object to remain with the upper tooling upon opening of the tooling whereby the object is supported by the first stream in a ready position against a bottom surface of the upper tooling;

(b) prior to locating the object in said ready position, initiating a second flow of pressurized gas through orifice means located adjacent to and directed across said ready position, thereby causing transfer of said object from the work station when the object is released at the ready position; and (c) discontinuing the second flow of pressurized gas through said orifice means after the object has exited the open tooling (d) receiving the object in a chute extending to a second work station which defines the transfer path to adjacent second upper and lower tools of the second work station, (e) directing the object into an extension of the transfer path defined by pivoting fingers located at opposite sides of the second tool, and (f) opening the fingers when the second tools are closing, and closing the fingers when the second tools are opening such as to guide the object into a centered position between the second station tools.

* * * * *